US005833580A

United States Patent [19]

Chiu

[11] Patent Number: 5,833,580

[45] Date of Patent: Nov. 10, 1998

[54] GRIP EXERCISE WITH A GEAR-SHAPED ADJUSTING MEMBER

[75] Inventor: Hsiu-Feng Chiu, Changhua, Taiwan

[73] Assignee: CIBER International Corp., Changhua, Taiwan

[21] Appl. No.: 877,022

[22] Filed: Jun. 17, 1997

[51] Int. Cl.[6] ..... A63B 23/16

[52] U.S. Cl. ..... 482/49; 482/126; 482/127

[58] Field of Search ..... 482/44, 49, 126, 482/127, 128

[56] References Cited

U.S. PATENT DOCUMENTS

| | | | |
|---|---|---|---|
| 5,072,927 | 12/1991 | Santos | 482/49 X |
| 5,222,926 | 6/1993 | Gugen | 482/49 |
| 5,360,385 | 11/1994 | Wang . | |
| 5,529,551 | 6/1996 | Chin | 482/49 |

*Primary Examiner*—Richard J. Apley
*Assistant Examiner*—William LaMarca
*Attorney, Agent, or Firm*—Browdy and Neimark

[57] ABSTRACT

An improved grip exerciser has a grip frame having a pair of handles and a receiving head disposed at the intersection of the two handles, and a gear-like adjusting member housed in the receiving head. The receiving head has a central hole and an axial split at the bottommost area and two axially extended protrusions each having a triangular cross section and disposed adjacent the split symmetrically. Each protrusion has a retaining cavity on its inner face respectively. Each dentiform rib of the adjusting member has a pair of retaining projections at the middle thereof. The receiving head has an upper area above the two symmetrical triangular protrusions which has a larger diameter than that of a lower area defined between the protrusions so as to permit the adjusting member to shift slightly when the grip exerciser is subject to force. The adjusting member has a through hole having multilateral curved sides. The pitch between two dentations of the gear-like adjusting member is a constant. The thickness between the bottom of a valley defined by two dentations and the multilateral curved side of the through hole is varied continuously from thick to thin clockwisely so that the adjusting member can be removed and adjusted with ease for different people.

4 Claims, 6 Drawing Sheets

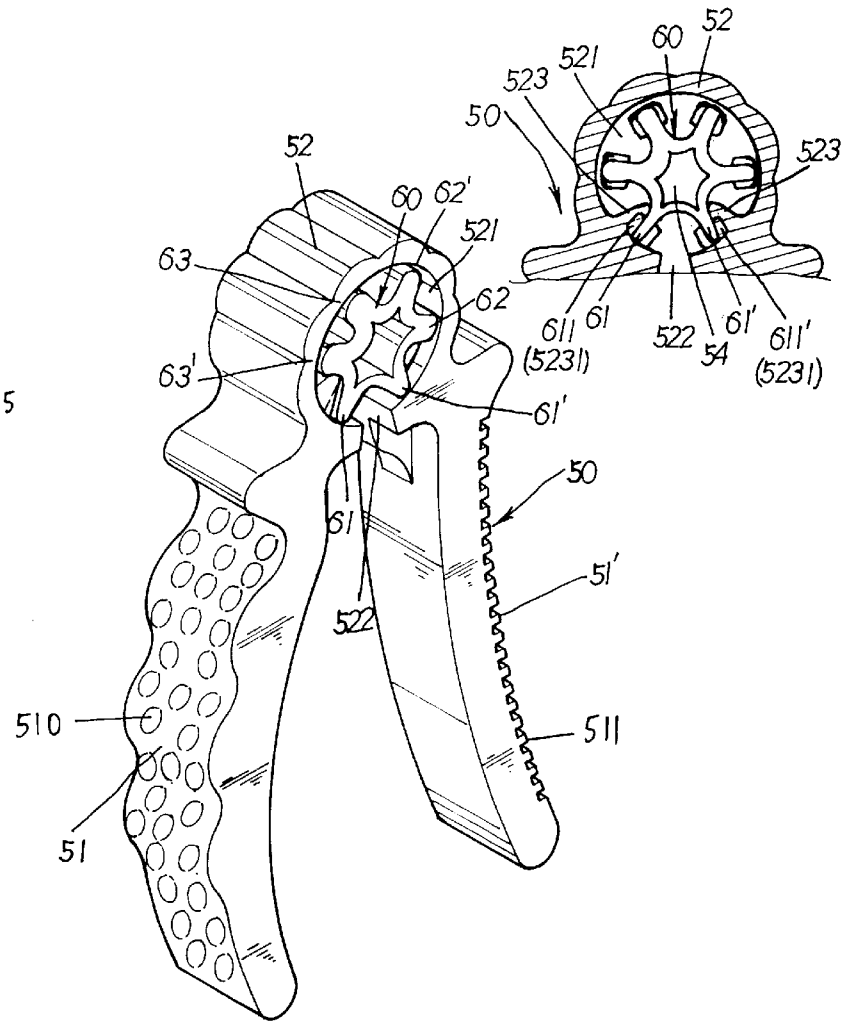
FIG. 4A
FIG. 4
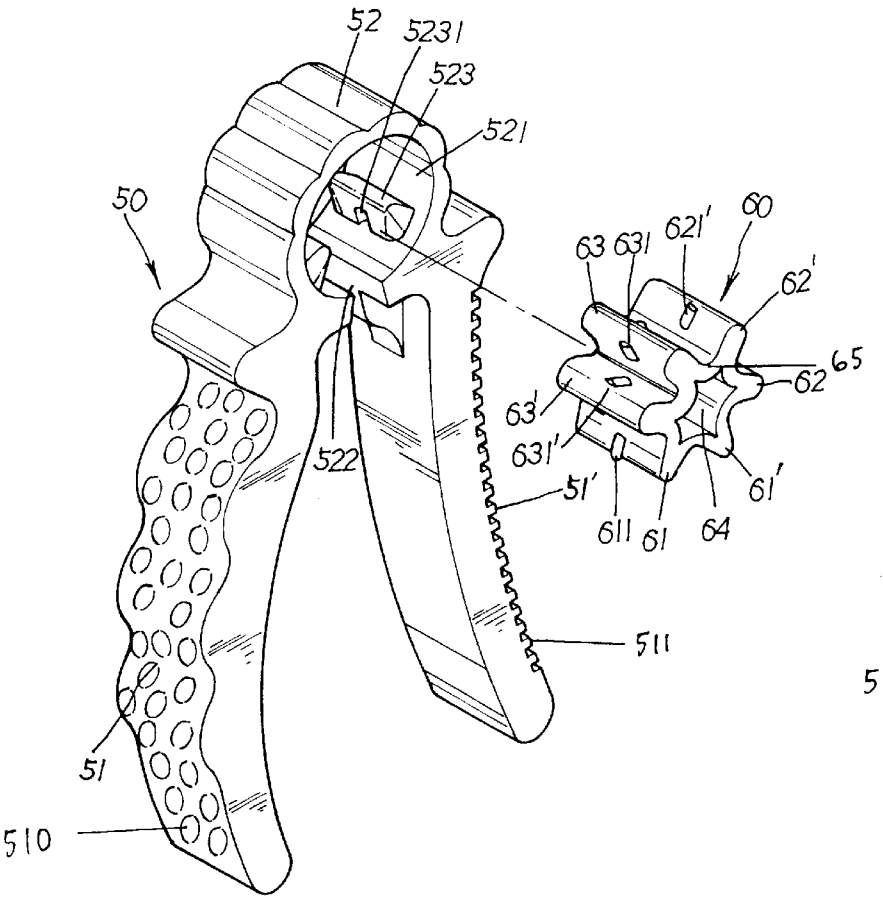
FIG. 3

GRIP EXERCISE WITH A GEAR-SHAPED ADJUSTING MEMBER

BACKGROUND OF THE INVENTION

1. Technical Field and Summary of the Invention

The present invention relates to an improved grip exerciser which has a grip frame having a pair of handles and a receiving head disposed at the intersection of the two handles, and a gear-like adjusting member housed in the receiving head. The receiving head has a central hole and an axial split at the bottommost area and two axially extended protrusions each having a triangular cross section and disposed adjacent the split symmetrically. Each protrusion has a retaining cavity on its inner face respectively. Each dentiform rib of the adjusting member has a pair of retaining projections at the middle thereof. The receving head has an upper area above the two symmetrical triangular protrusions which has a larger diameter than that of a lower area defined between the protrusions so as to permit the adjusting member to shift slightly when the grip exerciser is subjected to force. The adjusting member has a through hole having multilateral curved sides. The pitch between any two dentiform ribs of the gear-like adjusting member is a constant. The thickness between the bottom of a valley defined by two dentiform ribs and the multilateral curved side of the central opening is varied continuously from thick to thin in a circular direction.

2. Prior Art

Generally speaking, there are two types of conventional adjustable grip exercisers commonly available on markets, as shown in FIGS. 1, 2. The first type of grip exerciser is provided with a grip frame 10 and a number of heart-shaped attachment units 20 each having a split opening 21 at the bottom and a valley recess 22 at the top thereof and an engagement protrusion 23 disposed at each side and a peripheral flange 24 defined on the rear end thereof. The grip frame 10 has a pair of symmetric handles 11, 11' and a receiving head 12 defined at the intersection of the handles. The receiving head 12 has a bottom split cut 121 at the bottom and a central circular opening 120 for housing the attachment unit 20. The inner wall of the opening 120 is provided with a ring of high area 123 and a low area 122 and a pair of symmetric retaining cavities 1231 are disposed at the front edge of the opening 122. The attachment units 20 are provided with an opening 25 which can be different in size so as to make the attachment units 20 have various torsional resistance in nature. Each attachment unit 20 is housed in the central circular opening 120 by outwardly forcing the handles 11, 11' and then inserting the attachment unit 20 in the opening 120 with the peripheral flange 24 located in the low area 122 and the engagement protrusions 23 retained in the retaining cavities 1231. To remove the attachment unit 20, a reverse procedure is carried out for replacement of units to meet different needs.

Such prior art grip exerciser has the following disadvantages;

1. the attachment units can only be used for one purpose and they cause the production cost to be relatively high;

2. the attachment units are easily lost;

3. the replacement of the attachment units must be done with effort:

The second prior art is provided with a grip frame 30 and an elongated adjusting unit 40, as shown in FIGS. 2, 2A, 3. The grip frame 30 has a pair of symmetric handles 31 and a receiving head 32 having a central opening 322. On the inner face of the opening 322 are disposed a pair of symmetric flat extension 323 with a split space 321 left therebetween. The adjusting unit 40 is semi-cylindrical in shape and has a vertical flange 41 at each terminal and a horizontal holding extension 44 at one terminal. On the top roof of the arch-shaped adjusting unit 40 is provided with a number of indicating marks 43. As shown in FIG. 2A, on the inner face of the adjusting unit 40 are disposed a number of stepwisely reduced half cylindrical grooves 42.

In assembly, the adjusting unit 40 is inserted through the opening 322 by pushing the two handles 31 outwardly and is supported in place by the flat extensions 323. The pulling and pushing of the adjusting unit 40 with respect to the opening 322 vary the torsional resistance of the grip exerciser.

The disadvantages of the second prior art are listed as below;

1. the outward extension of the adjusting unit makes the appearance of the grip exerciser unpleasant to the eyes;

2. the extended adjusting unit can be accidentally pushed in use so as to make the torsional resistance of the grip exerciser varied without notice;

3. the handles of the grip frame must still be forced outwardly with effort to insert the adjusting unit.

OBJECT OF THE INVENTION

Therefore, the primary object of the present invention is to provide an improved grip exerciser which is equipped with only one gear-shaped adjusting member so as to reduce the production cost and materials used.

Another object of the present invention is to provide a grip exerciser having an adjusting member which is easy to mount to and dismount from the grip exerciser for adjustment.

One further object of the present invention is to provide a grip exerciser equipped with an adjusting member which can be rotatorily adjusted as long as the adjusting member is taken partially out from either right side or left side, disengaging from the retaining cavities of the longitudinal protrusions and the longitudinal protrusions themselves so that the grip exerciser can be easily adjusted and be suitable for right-hand people or lefties.

BRIEF DESCRIPTION OF THE DRAWINGS

FIG. 3 is a diagram showing the exploded components of the first embodiment of the grip exerciser of the present invention;

FIG. 4 is a diagram showing the assembled grip exerciser of the first embodiment of the present invention;

FIG. 4A is a sectional diagram showing the adjusting member engaged with the receiving head of the grip exerciser of FIG. 4;

DETAILED DESCRIPTION OF THE PREFERRED EMBODIMENTS

Figure 1:
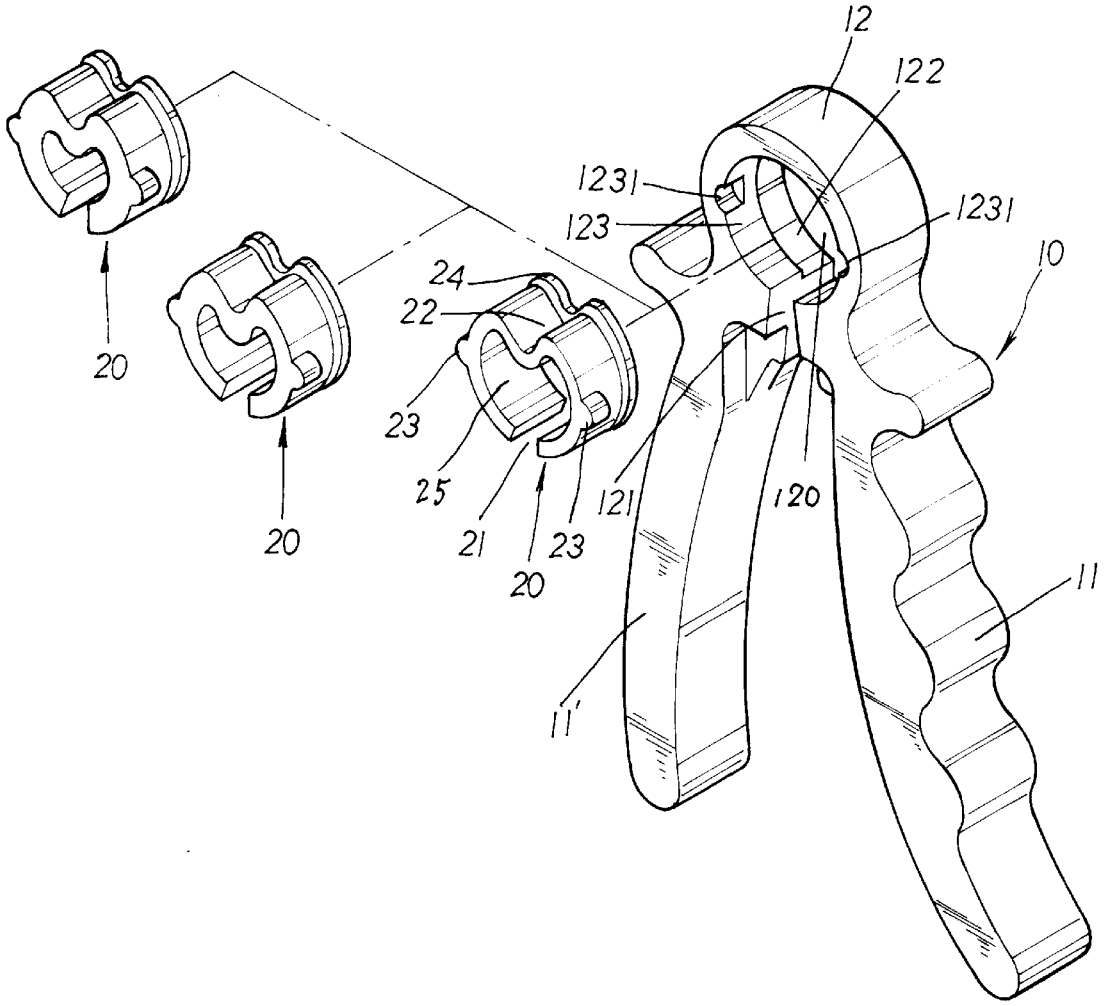
FIG. 1 PRIOR ART
FIG. 1 is a diagram showing a first prior art grip exerciser.
Figures 2, 2A:
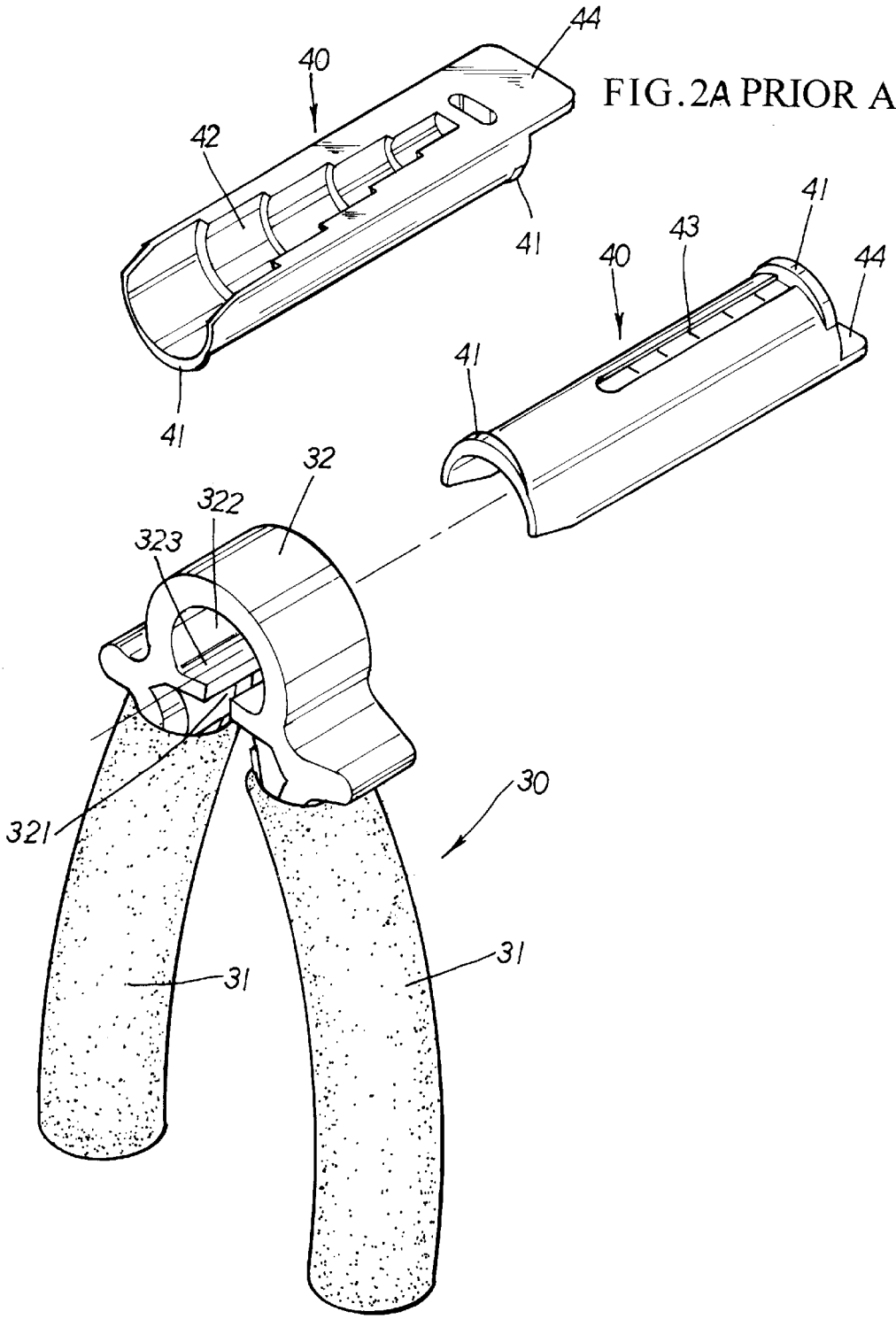
FIG.2A PRIOR ART
FIG.2 PRIOR ART
FIG. 2 is a diagram showing a second prior art grip exerciser.
FIG. 2A is a diagram showing the reverse side of the adjusting unit of the second prior art.
Figure 5A:
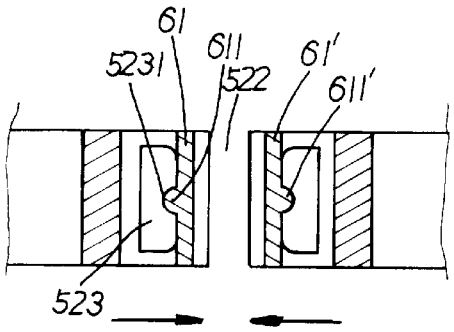
FIGS. 5A, 5B, 5C are sectional diagrams showing the mounting, dismounting and adjustment of the gear-shaped adjusting member in series.
Figure 5B:
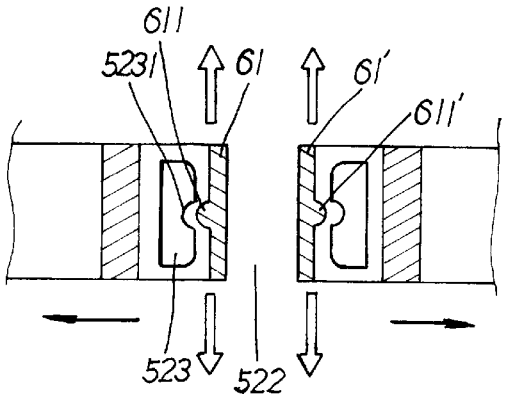
Figure 5C:
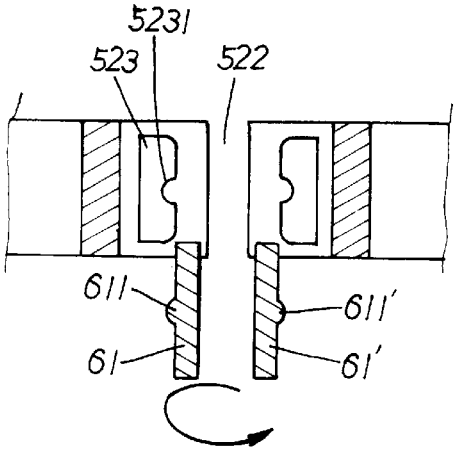

Referring to FIGS. 3, 4, 4A, the improved grip exerciser of the present invention comprising a grip frame 50 and a gear-shaped adjusting member 60. The grip frame 50 has a pair of handles 51, 51' one having a plurality of protruded spots 510 and the other having a plurality of parallel ribs 511 defined thereon. A receiving head 52 defined at the intersection of the handles 51, 51' has a central hole 521 and a split 522 at the bottom thereof.

The receiving head 52 of the grip frame 5 is divided by the split 522 into two connected arc portions. On each arc portion an axial protrusion 523 having a triangular cross section is disposed. Each end of the triangular protrusion 523 is smoothly cornered for easy insertion of the adjusting member 60 and spaced apart from the split 22 of the central hole 521 of the receiving head 52. The area defined above the two axial protrusions 523 has a larger diameter than that of an area below the two protrusions 523 so as to permit adjusting member 60 to have a room to shift when the grip exerciser is subjected to force wrong use.

Each axial triangular protrusion 523 is provided with a retaining cavity 5231 at the middle of an inner face which is defined in the faces facing to each other of the two protrusions 523.

The adjusting member 60 is of a gear-shaped form provided with a plurality of radially extended consecutive spaced dentiform ribs 61, 61', 62, 62', 63, 63'. The central opening 64 is a of a multilateral form, having curvilinear sides.

Each of the spaced dentiform ribs 61, 61', 62, 62', 63, 63' of the adjusting member 60 has respectively a pair of retaining projections 611, 611; 611', 611'; 621, 621; 621', 621'; and etc. symmetrically disposed at the middle thereof in selective locking engagement with the retaining cavities 5231 of the axial triangular protrusions 523 of the central hole 521 in assembly.

The gear-shaped adjusting member 60 has a plurality of spaced axial dentiform ribs having a constant pitch between any two thereof. A valley area is defined between any two spaced axial dentiform ribs. The distance 65 defined between each valley area and each corresponding multilateral curvilinear side of the central opening 64 is varied from thick to thin gradually in a circular direction so as to produce different torsional resistance between every two axial dentiform ribs.

In practical operation, when the two handles 51, 51' of the grip frame 50 are outwardly separated, the gear-shaped adjusting member 60 is easily inserted into the receivng head 52 via the central hole 521 with two of the axial dentiform ribs 61, 61', 62, 62'. . . selectively located between the triangular protrusions 523 and one of the retaining projections 611, 611', 621, 621', 631, 631' of the two selected ribs engaged with each corresponding retaining cavity 5231 of the triangular protrusions 523 in assembly.

The adjusting member 60 can be easily rotated for adjustment by forcing the two handles 51, 51' to separate so as to disengage the engaged retaining projections of the two selected dentiform ribs from the retaining cavities 5231 of the triangular protrusions 523. The adjusting member 60 is further pulled out from either end of the central hole 521 to free the dentiform ribs of the adjusting member 60 from restraint of the two triangular protrusions 523 so that the adjusting member 60 can be rotated for adjustment of the torsional resistance of the grip exerciser with ease by new selection of two dentiform ribs to engage with the triangular protrusions 523.

As shown in FIG. 3, the multilateral central opening 64 can be defined in a hexagonal form, or other shape as one wishes.

Figure 6:
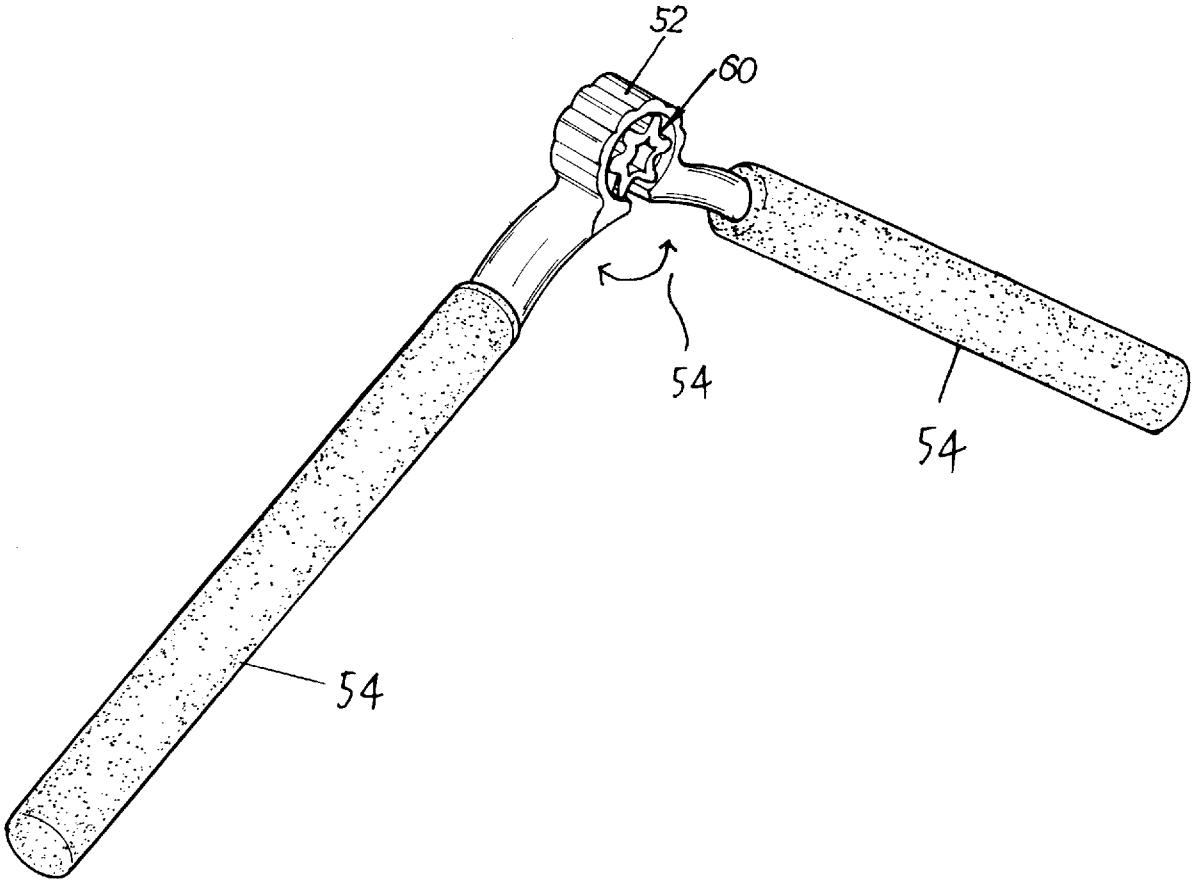
FIG. 6 is a diagram showing the present invention applied to an arm exerciser.

Referring to FIG. 6, the handles 54 of the grip frame 50 are extended with the angle 55 between the handles 54 enlarged so as to convert the grip exerciser into an arm exerciser.

Figure 7:
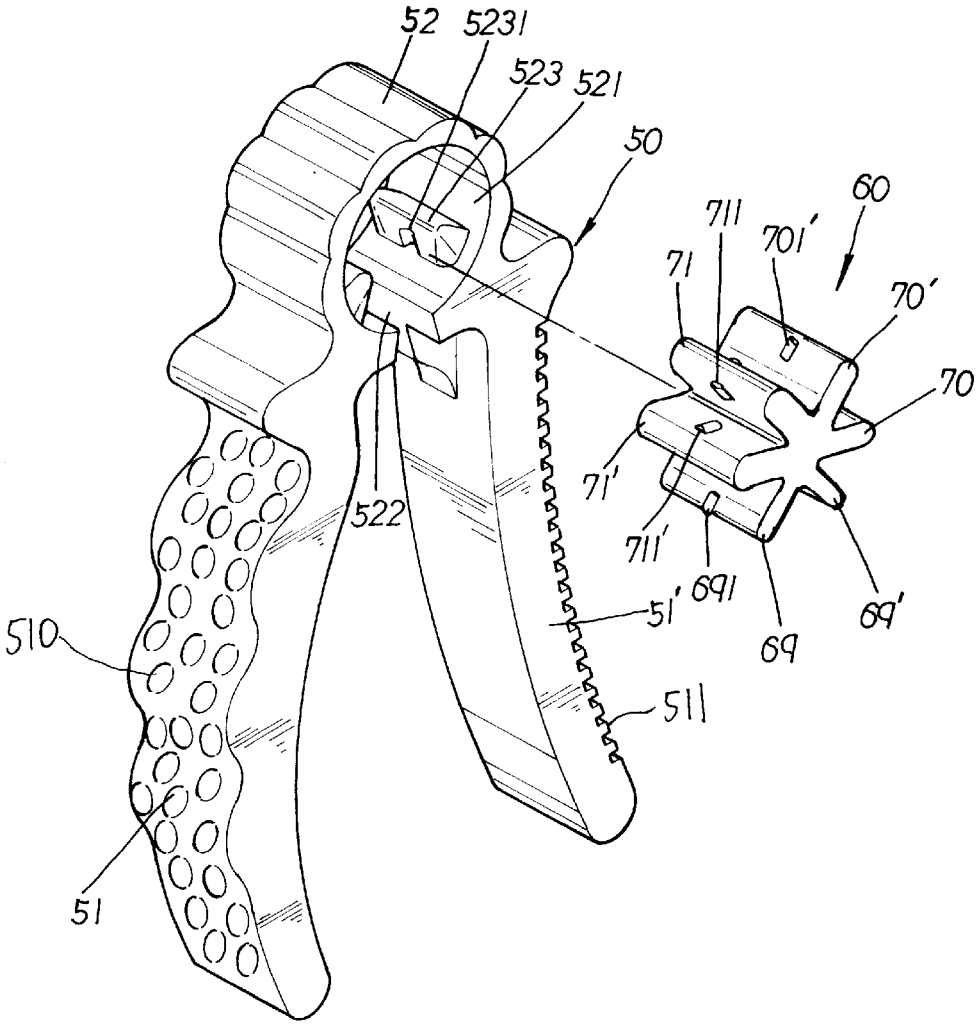
FIG. 7 is a diagram showing another embodiment of the present invention.

Referring to FIG. 7, the gear-shaped adjusting member 60 is not equipped with a central opening and has a plurality of spaced axial dentiform ribs 69, 69', 70, 70', 71, 71' having a constant pitch between every two ribs and a various lateral thickness gradually decreased in a circular direction. On each of the dentiform ribs are disposed a pair of retaining projections 691, (691', 701 not shown), 701', 711, 711' too.

I claim:

1. An improved grip exerciser comprising a grip frame and an adjusting member: said grip frame having a pair of handles one of said handles having a plurality of protrudes spots and one other of said handles having a plurality of parallel strip defined thereon; and a receiving head disposed at the intersection of said two handles; said receiving head having a central hole and a split at the bottom thereof;

said receiving head of said grip frame being divided by said split into two connected arc portions; on each said arc portion an axial protrusion having a triangular cross section being disposed; said central hole having an area defined above said two axial protrusion having a larger diameter than a diameter through an area defined below said two axial protrusions so as permit said adjusting member to have space to shift when said grip exerciser is being subjected to force during use;

each end of said triangular protrusion being smoothly cornered for easy insertion of said adjustment member and being spaced apart from said split of said central opening of said receiving head; each said axial triangular protrusion being provided with a retaining cavity at the middle of an inner face which is defined in each face facing each other of said two protrusions;

said adjusting member having a gear-like structure provided with a plurality of radially extended consecutive spaced dentiform ribs and a central opening having curvilinear sides;

each of said spaced dentiform ribs of said adjusting member having a pair of retaining projections symmetrically disposed at the middle thereof for locking engagement with said retaining cavities of said axial triangular protrusion of said central opening in assembly;

said plurality of spaced axial dentiform ribs having a constant pitch between any two thereof;

a valley area being defined between any two said spaced axial dentiform ribs;

a distance being defined between each said valley area and each corresponding curvilinear side of said curvilinear sides of said central opening;

said distance being varied from thick to thin gradually in a circular direction so as to produce different torsional resistance between every two axial ribs;

whereby when said two handles of said grip frame are outwardly separated, said adjusting member is easily inserted into said receiving head via said central hole with two of said spaced axial dentiform ribs selectively located between said triangular protrusions and one of said retaining projections of said two selected ribs engaged with each said corresponding retaining cavity of said triangular protrusions in assembly;

said adjusting member being easily rotated for adjustments by forcing said two handles to separate so as to disengage said engaged retaining projections of said two selected ribs from said retaining cavities of said triangular protrusions and said adjusting member pulled out from either end of said central hole to free said dentiform ribs of said adjusting member from restraint of said two triangular protrusions so that said adjusting member can be rotated for adjustment of torsional resistance of said grip exercise with ease.

2. The improved grip exerciser as claimed in claim 1 wherein said central opening has a hexagonal form.

3. The improved grip exerciser as claimed in claim 1 wherein said handles of said grip frame are extended with an enlarged angle between said handles so as to convert said grip exerciser into an arm exerciser.

4. An improve grip exerciser comprising a grip frame and an adjusting member;

said grip frame having a pair of handles one of said handles having a plurality of protruded spots and one other of said handles having a plurality of parallel strips defined thereon;

and a receiving head having a central hole and a split at the bottom thereof;

said receiving head of said grip frame being divided by said split into two connected arc portions;

on each said arc portion an axial protrusion having a triangular cross section being disposed;

said central hole having an area defined above said two axial protrusions having a larger diameter than a diameter through an area defined below said two axial protrusions so as to permit said adjusting member to have space to shift when said grip exerciser being subjected to force during use;

each end of said triangular protrusion being smoothly cornered for easy insertion of said adjusting member and being spaced apart from said split of said central opening of said receiving head;

each said axial triangular protrusion being provided with a retaining cavity at the middle of an inner face which is defined in each face facing each other of said two protrusions;

said adjusting member having a gear-like structure provided with a plurality of radially extended consecutive spaced dentiform ribs having a constant pitch between each pair of said ribs, each of said ribs having a lateral thickness which decreases in a circular direction around said adjusting member, each of said ribs of having a pair of retaining projections symmetrically disposed at the middle thereof in locking engagement with said retaining cavities of said axial triangular protrusions of said central opening in assembly;

whereby when said two handles of said grip frame are outwardly separated, said adjusting member is easily inserted into said receiving head via said central hole with a pair of said spaced axial dentiform ribs selectively located between said triangular protrusions and one of said retaining projections of said pair of selected ribs engaged with each said corresponding retaining cavity of said triangular protrusions in assembly;

said adjusting member being easily rotated for adjustment by forcing said two handles to separate so as disengage said engaged retaining projections of said pair of selected ribs from said retaining cavities of said triangular protrusion, and said adjusting member being pulled out from either end of said central hole to free said ribs from restraint of said two triangular protrusions so that said adjusting member can be rotated for adjustment of torsional resistance of said grip exerciser with ease.

* * * * *